US011267020B2

(12) United States Patent
Benedetti

(10) Patent No.: US 11,267,020 B2
(45) **Date of Patent: *Mar. 8, 2022**

(54) APPARATUS FOR TREATING HORTICULTURAL PRODUCTS, SUCH AS BLUEBERRIES AND THE LIKE

(71) Applicant: UNITEC S.P.A., Lugo (IT)

(72) Inventor: Luca Benedetti, Ravenna (IT)

(73) Assignee: UNITEC S.P.A., Lugo (IT)

( * ) Notice: Subject to any disclaimer, the term of this patent is extended or adjusted under 35 U.S.C. 154(b) by 744 days.

This patent is subject to a terminal disclaimer.

(21) Appl. No.: 16/078,838

(22) PCT Filed: Feb. 24, 2017

(86) PCT No.: PCT/EP2017/054266
§ 371 (c)(1),
(2) Date: Aug. 22, 2018

(87) PCT Pub. No.: WO2017/144632
PCT Pub. Date: Aug. 31, 2017

(65) Prior Publication Data

US 2019/0047023 A1 Feb. 14, 2019

(30) Foreign Application Priority Data

Feb. 24, 2016 (IT) ..... 102016000018797

(51) Int. Cl.
*B07C 5/34* (2006.01)
*B07C 5/342* (2006.01)
(Continued)

(52) U.S. Cl.
CPC ..... *B07C 5/342* (2013.01); *B07C 5/02* (2013.01); *B07C 5/368* (2013.01); *B07C 2501/009* (2013.01)

(58) Field of Classification Search
CPC B07C 5/02; B07C 5/342; B07C 5/368; B07C 2501/009
See application file for complete search history.

(56) References Cited

U.S. PATENT DOCUMENTS 6,060,677 A * 5/2000 Ulrichsen ..... B07C 5/3425 209/577
8,714,362 B2 * 5/2014 Jones ..... B07B 1/469 209/245

(Continued)

FOREIGN PATENT DOCUMENTS

CL 2018002418 A1 12/2018
FR 2976195 A1 12/2012

OTHER PUBLICATIONS

International Search Report dated May 3, 2017 re: Application No. PCT/EP2017/054266, pp. 1-3, citing: FR 2 976 195 A1.

(Continued)

*Primary Examiner* — Michael McCullough
*Assistant Examiner* — Kalyanavenkateshware Kumar
(74) *Attorney, Agent, or Firm* — Cantor Colburn LLP

(57) ABSTRACT

An apparatus for treating horticultural products, such as blueberries and the like, includes in series at least one station for loading the horticultural products, at least one preliminary checking station, at least one alignment station, for their subsequent advancement aligned on at least one row, at least one viewing station, for acquiring information related to at least one parameter of interest of each horticultural product, such as the color, size, shape, sugar content, defectiveness, and the like, at least one distribution station, for sorting the products into uniform subgroups, as a function of the information acquired by the viewing station, and at least one recirculation apparatus for returning, at least to the (Continued)

viewing station, any horticultural products that have not been sorted by the distribution station.

10 Claims, 9 Drawing Sheets

(51) Int. Cl.
*B07C 5/36* (2006.01)
*B07C 5/02* (2006.01)

(56) References Cited

U.S. PATENT DOCUMENTS

2013/0313169 A1* 11/2013 Lapeyre ..... B07C 5/00 209/546
2019/0054503 A1 2/2019 Benedetti

OTHER PUBLICATIONS

Written Opinion dated May 3, 2017 re: Application No. PCT/EP2017/054266, pp. 1-4, citing: FR 2 976 195 A1.

* cited by examiner

APPARATUS FOR TREATING HORTICULTURAL PRODUCTS, SUCH AS BLUEBERRIES AND THE LIKE

TECHNICAL FIELD

The present disclosure relates to an apparatus for treating horticultural products, such as blueberries and the like.

BACKGROUND

Currently, industrial processes have an ever increasing level of automation, since only by entrusting to machines and robots the execution of the various steps of the treatment and processing of raw materials and of intermediate products is it possible to meet market demands.

In various fields of application, in fact, the market is now very large and at the same time is composed of highly demanding clients (in terms of costs and quality): automation allows to combine the various requirements, providing on a large scale and at modest costs products that comply with the required quality standards.

This situation is certainly shared by the food industry as well: in even greater detail, companies that process and distribute horticultural products on an industrial scale indeed resort to automated apparatuses and lines to handle, check, grade, package and more generally treat said horticultural products.

According to known methods, some of these apparatuses are fed, at a loading station, with unsorted masses of a specific fruit (or other horticultural product), which often arrive directly from the picking fields.

In this section, adequate handling systems then transfer the products to the subsequent stations.

In greater detail, after undergoing some preliminary checks, the products are subjected one by one to the action of video cameras or similar vision systems, which analyze them and, by means of adapted software, check for each one of them the value assumed by one or more parameters of interest, such as for example color, shape and size, sugar content, ripeness, any rotting, etc.

Downstream of the video cameras, each product is then moved along a subsequent portion, which is affected by a plurality of unloading devices, which are arranged in sequence and can be operated in a mutually independent manner.

Each device faces or in any case is functionally associated with a respective collection container: for each fruit it is thus possible to activate the device that corresponds to the container in which one wishes to place it.

In this sense, the choice is indeed made as a function of the values assumed by the parameters of interest: uniform products, to be destined to packaging and distribution or to further processing steps, thus accumulate in each container.

The check performed by the video cameras is not free from problems that are not easy to solve: the great variety with which these products appear to the video cameras, as well as the variability of the surrounding (environmental) conditions in which the readings are made, sometimes prevents the correct detection of the parameters of interest, also due to technical limitations of the video cameras themselves and/or of the analysis software that has the task of processing the acquired images.

Known apparatuses therefore have adapted recirculation devices, arranged downstream of the video cameras, which retrieve the fruits for which reading is not performed, sending them back to the upstream stations, in practice subjecting them to a new cycle (trusting that the error will not reoccur).

The general structure thus outlined is frequently adopted in particular for small fruits such as cherries or blueberries, but it has drawbacks.

When the reprocessed fruits exceed a minimum (tolerable) threshold, as occurs for example when an unwanted negative drift in the operation of the video cameras occurs, a highly unwanted reduction of overall productivity is obtained.

The number of products delivered to the collection containers in the unit time is in fact reduced significantly, since many of the fruits initially loaded upstream are subjected to at least two treatment cycles before they are indeed delivered to the collection containers.

Moreover, it is important to note that the operation described so far is substantially automated: even in case of a large increase in the number of products not read by the video cameras in the first cycle, the recirculation devices are in any case capable of recovering the products, but these negative drifts cause the apparatus to operate for a long time in non-optimal conditions.

In practice, in other words, the automated operation of the recirculation apparatus allows to avoid rejects and the risk that products that are not distributed correctly end up in areas of the apparatus that are not dedicated to them, but at the same time allows operation even when malfunctions of the video cameras or of other stations cause low productivity of the apparatus, which is obviously unwelcome.

Moreover, in extreme conditions an excessive number of untreated fruits, due indeed to a malfunction of the upstream stations, may sometimes exceed the capacity of the recirculation apparatus, causing jamming and/or deterioration of the fruits.

These inconveniences are even more unwelcome indeed when these apparatuses or lines are designed for the treatment of blueberries.

The blueberry is in fact a substantially valuable fruit, due to its lower availability in nature, which contrasts with a high appreciation by customers, and therefore cost containment (obviously associated with the productivity of the corresponding processing line and with the capability to reduce waste) is crucial in order to be able to offer in any case the product to the public at competitive costs, at the same time maintaining an adequate profit margin.

At the same time, this is a highly delicate fruit, which requires great care in its handling in order to avoid subjecting it to impacts: all reprocessing is therefore preferably to be avoided, indeed to reduce the risk of damaging it.

SUMMARY

The aim of the present disclosure is to solve the problems described above, by providing an apparatus that is capable of detecting promptly a negative drift in the operation of the video cameras assigned to viewing the blueberries.

Within this aim, the disclosure provides an apparatus that is capable of promptly detecting productivity drops caused by non-optimal operation of the video cameras.

The disclosure also provides an apparatus that allows to reduce the number of horticultural products subjected to reprocessing.

The disclosure further provides an apparatus that ensures high reliability in operation and can be obtained easily starting from commonly commercially available elements and materials.

The disclosure proposes an apparatus that adopts a technical and structural architecture that is alternative to those of apparatuses of the known type.

The disclosure further provides an apparatus that has modest costs and is safe in application.

This aim and these and other advantages that will become better apparent hereinafter are achieved by providing an apparatus for treating horticultural products, such as blueberries and the like, comprising in series at least one station for loading the horticultural products, at least one preliminary checking station, at least one alignment station, for their subsequent advancement aligned on at least one row, at least one viewing station, for acquiring information related to at least one parameter of interest of each horticultural product, such as the color, size, shape, sugar content, defectiveness, and the like, at least one distribution station, for sorting the products into uniform subgroups, as a function of the information acquired by said viewing station, and at least one recirculation apparatus, for returning, at least to said viewing station, any horticultural products that have not been sorted by said distribution station, characterized in that said recirculation apparatus comprises at least one conveyor belt, which is functionally arranged downstream of said distribution station and leads even indirectly to said viewing station, said apparatus comprising at least one sensor for detecting the transit of horticultural products above and at a predefined height, with respect to said conveyor belt, said height being chosen so as to correspond to a predefined limit value of products that have accumulated and are passing on said conveyor belt.

BRIEF DESCRIPTION OF THE DRAWINGS

Further characteristics and advantages of the disclosure will become better apparent from the description of a preferred but not exclusive embodiment of the apparatus according to the disclosure, illustrated by way of nonlimiting example in the accompanying drawings, wherein.

DETAILED DESCRIPTION OF THE DRAWINGS

Figure 1:
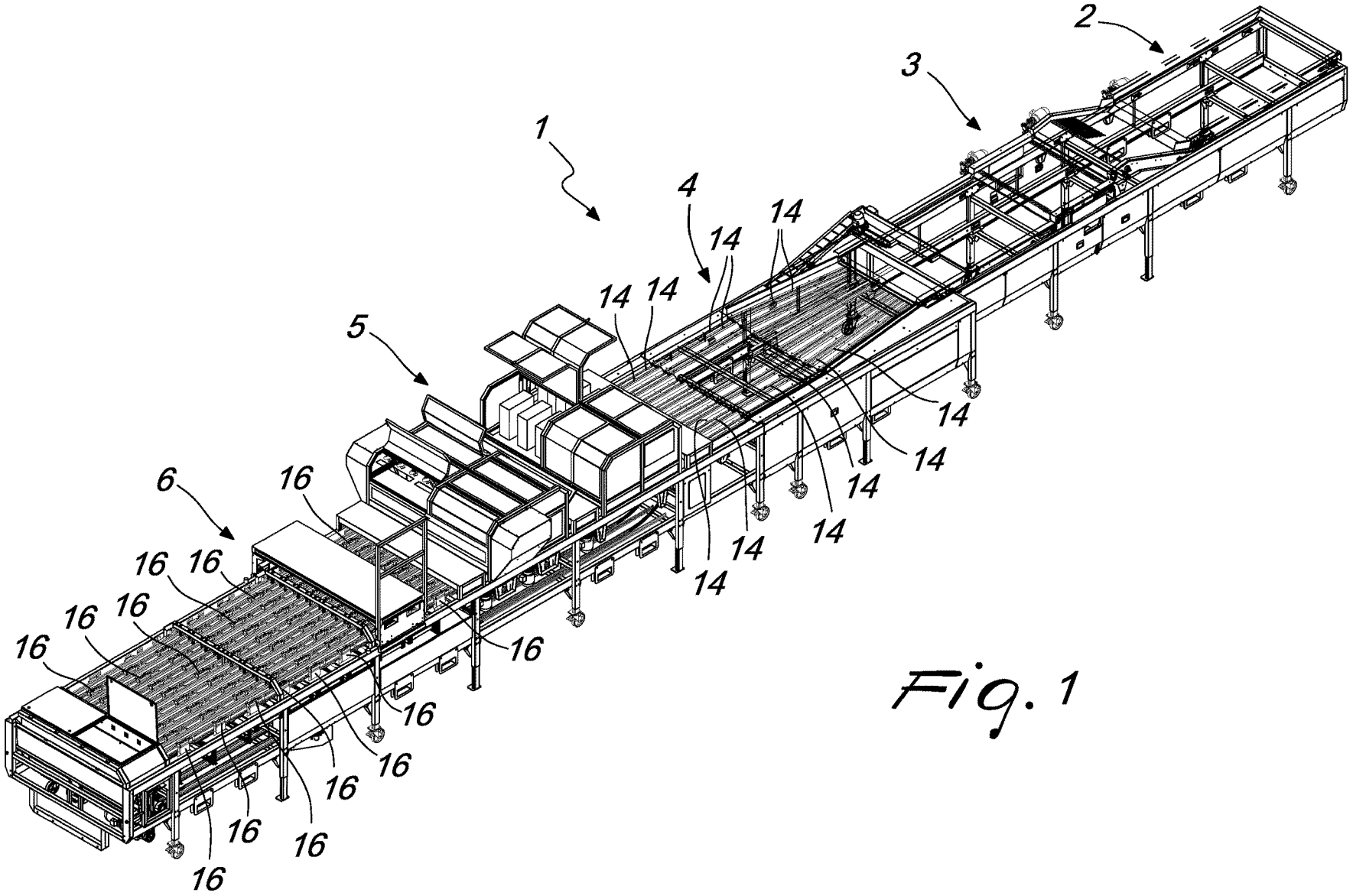
FIG. 1 is a lateral rear perspective view of the apparatus according to the disclosure.

With particular reference to FIGS. 1-11, the reference numeral 1 generally designates an apparatus for treating horticultural products A, of the type of blueberries and the like.

In greater detail, it is specified from the outset that in the preferred application of the disclosure, to which reference will be made often in the continuation of the present description and which highlights the particularities of said disclosure, the horticultural products A are indeed blueberries.

Likewise, use of the apparatus 1 for similar horticultural products A, such as cherries, strawberries, blackberries or raspberries, or even of a different type, as a function of the specific practical requirements, is also provided in any case.

Therefore, it is useful to specify that any specific reference to blueberries that will be made in the pages that follow is to be understood as extended to any other horticultural product A.

Figure 2:
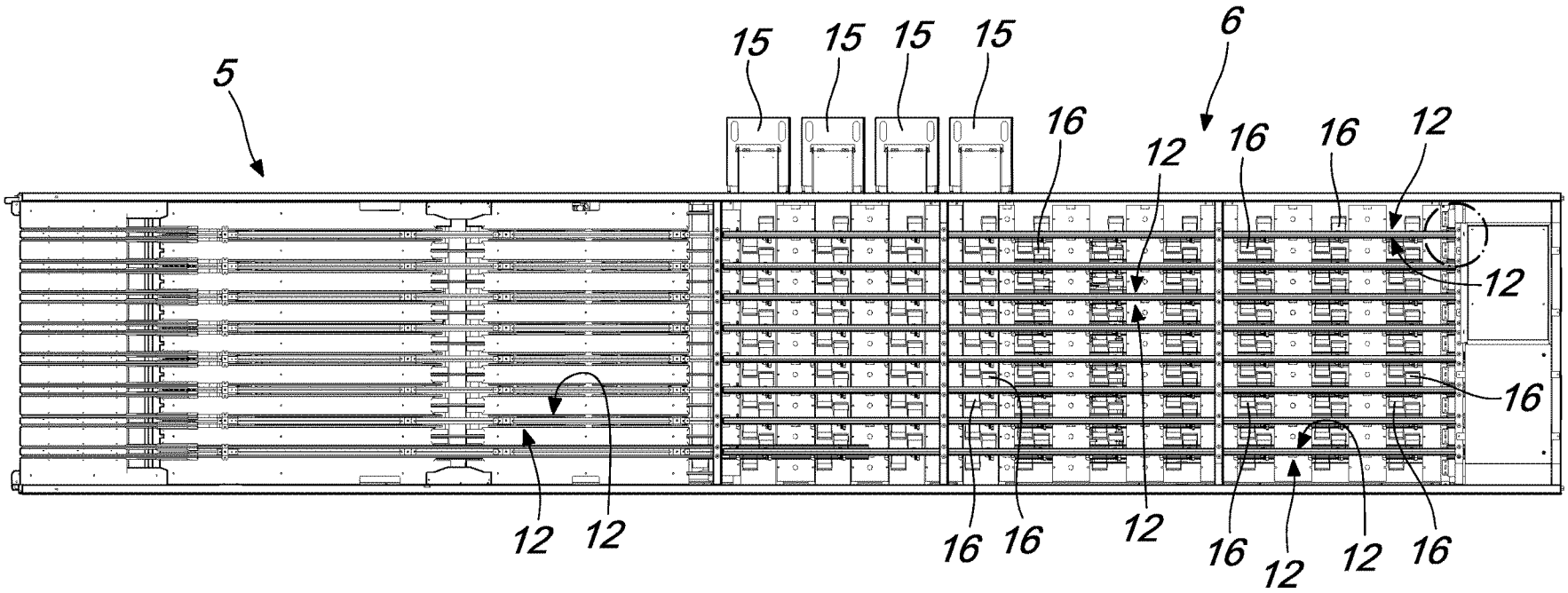
FIG. 2 is a top view of an end part of the apparatus of FIG. 1.
Figure 3:
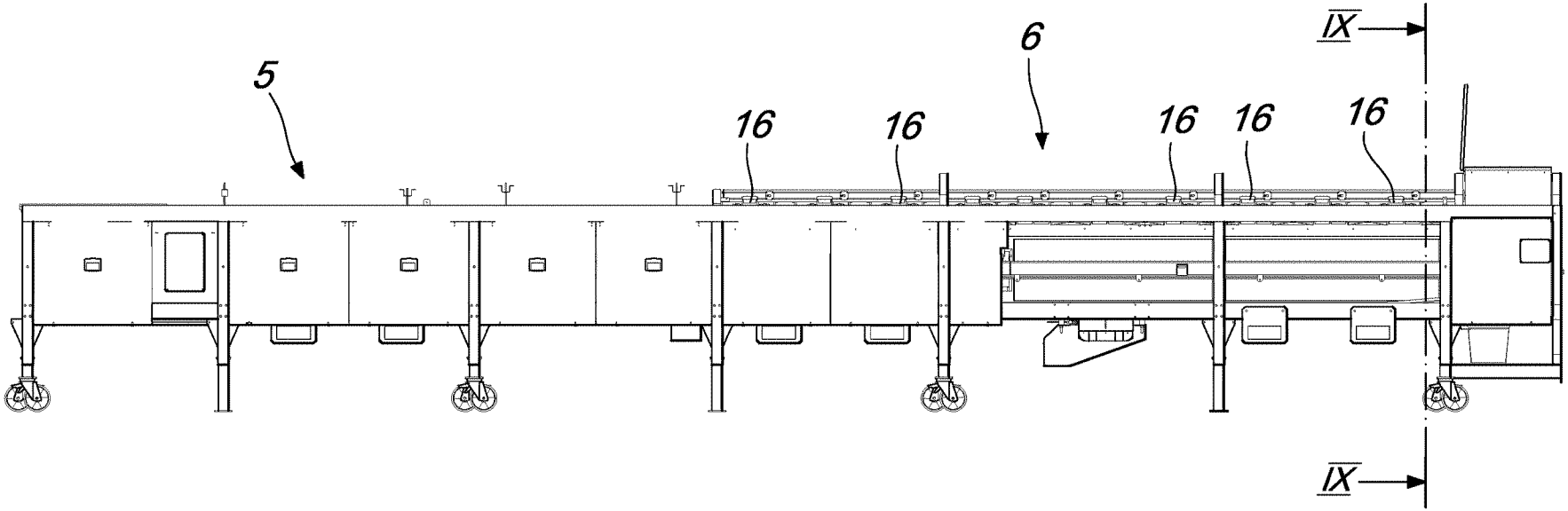
FIG. 3 is a front view of the part of the apparatus shown in FIG. 2.
Figure 4:
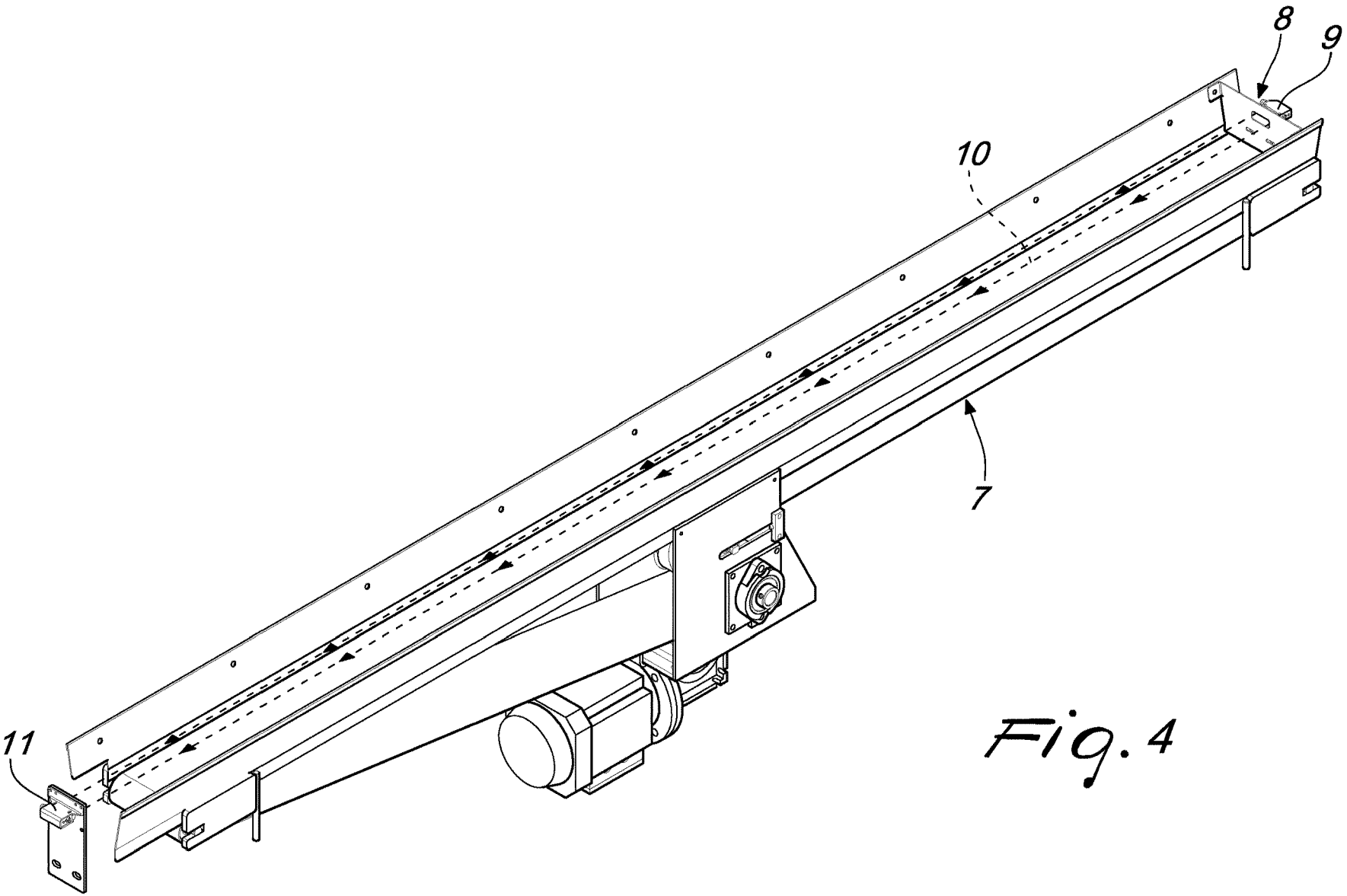
FIG. 4 is perspective view of the detection sensor and of the conveyor belt of the recirculation apparatus.
Figure 5:
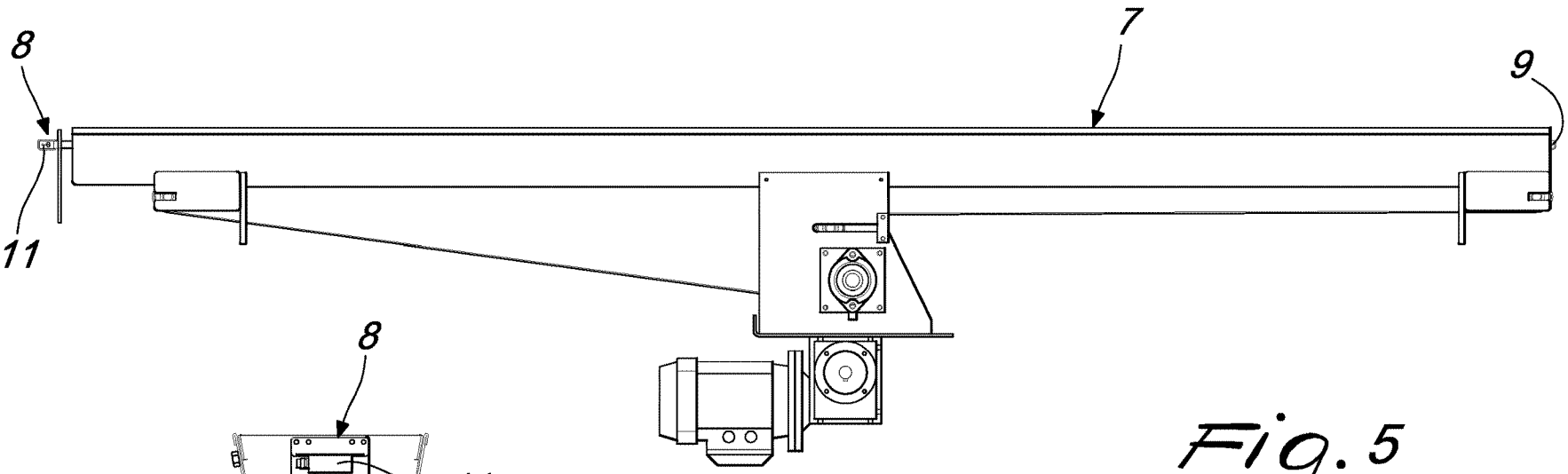
FIG. 5 is a side elevation view of the components of FIG. 4.
Figure 6:
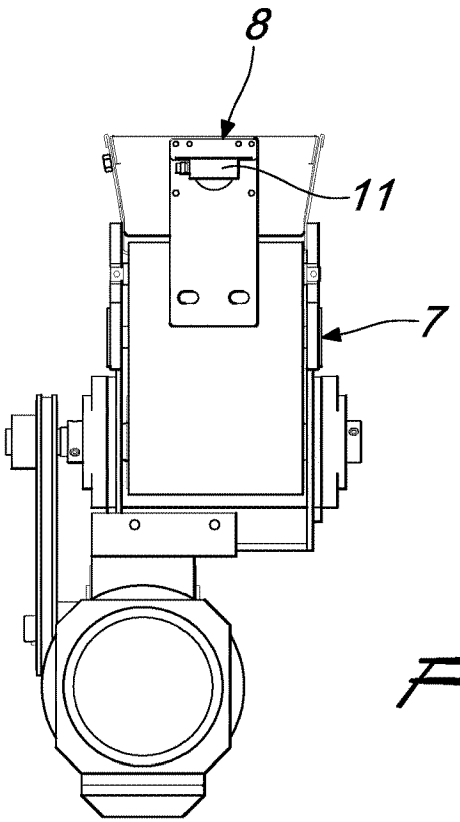
FIG. 6 is a front view of the components of FIG. 4.
Figure 7:
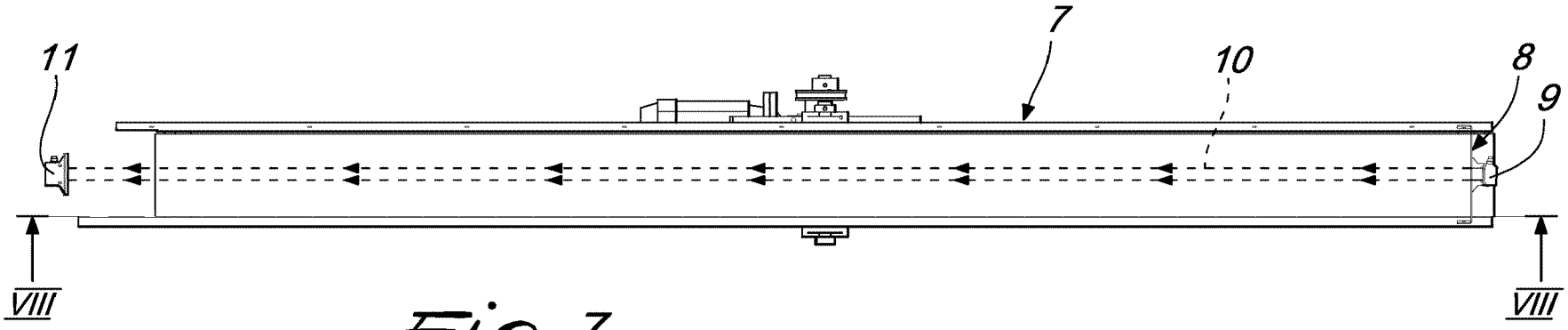
FIG. 7 is a top view of the components of FIG. 4.
Figure 8:
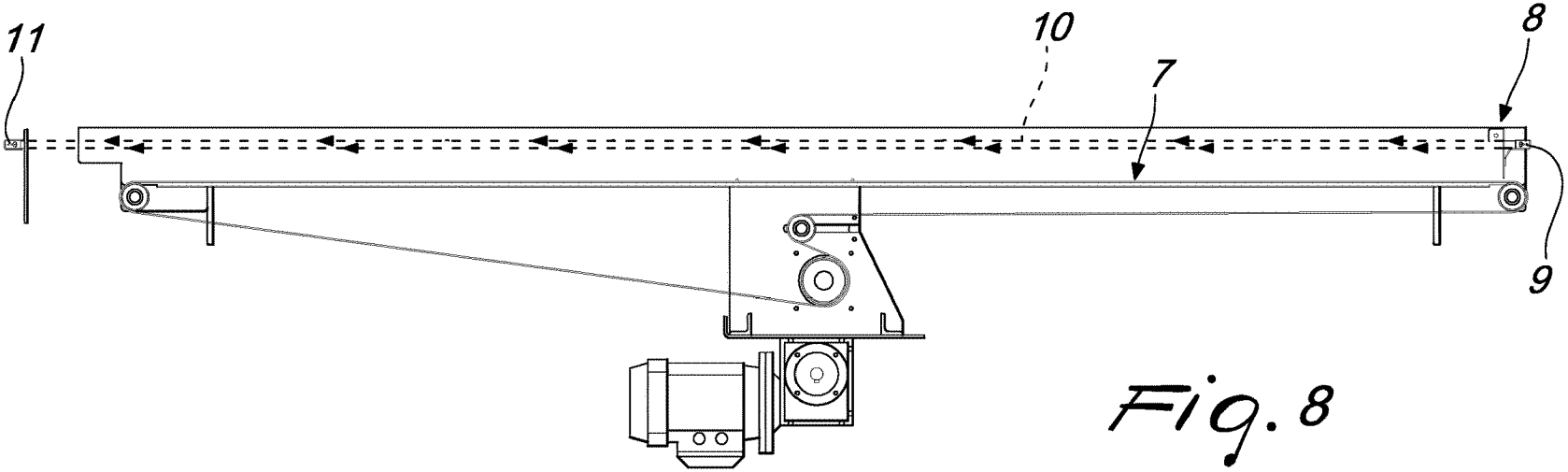
FIG. 8 is a sectional view of FIG. 7, taken along the line VIII-VIII.
Figure 9:
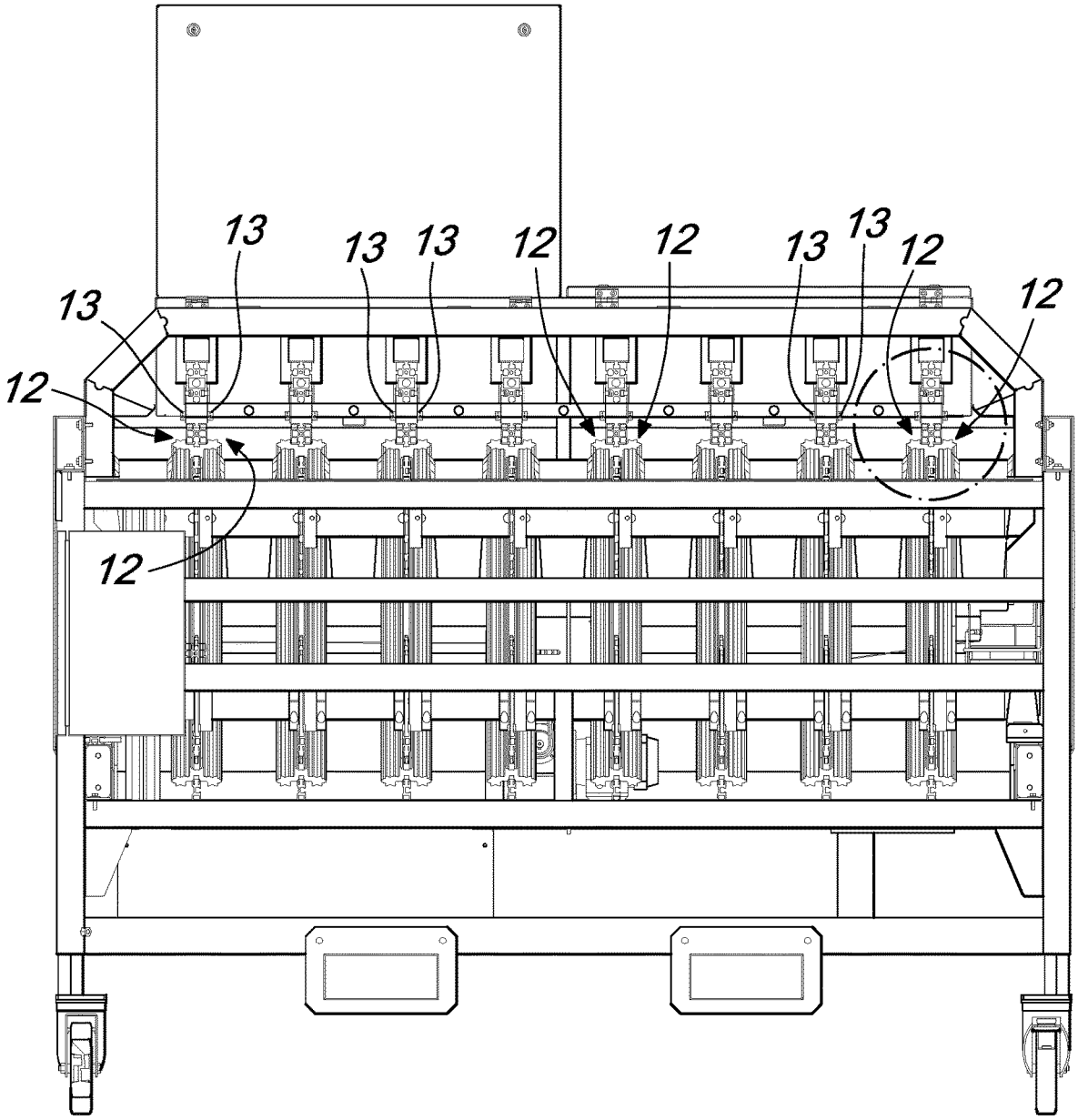
FIG. 9 is a sectional view of FIG. 3, taken along the line IX-IX.
Figure 10:
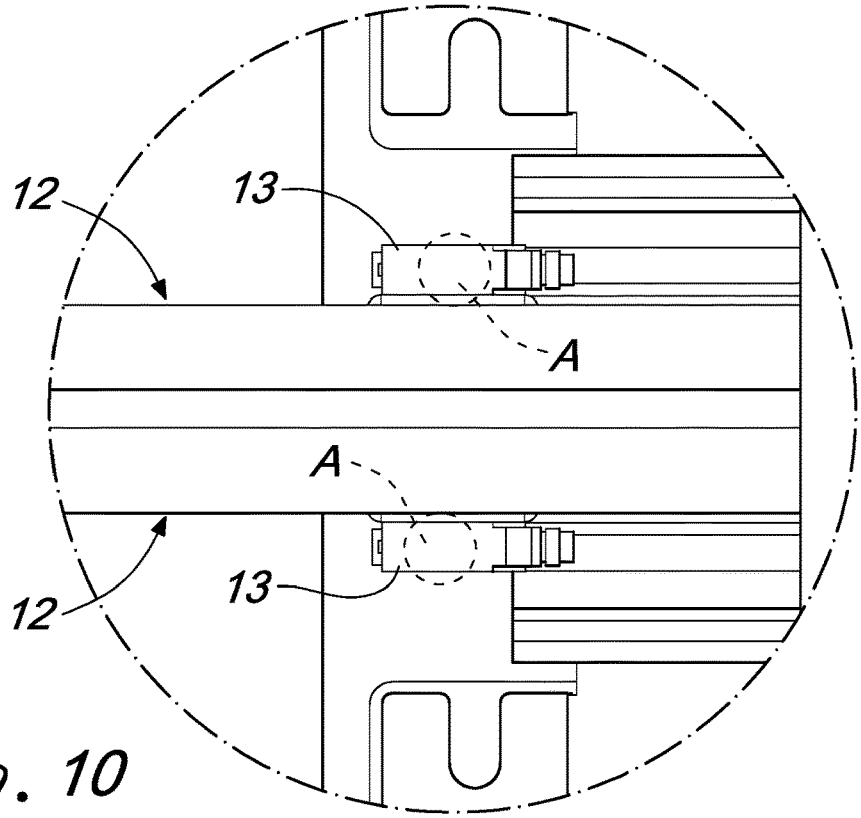
FIG. 10 is a highly enlarged-scale view of a detail of FIG. 2.
Figure 11:
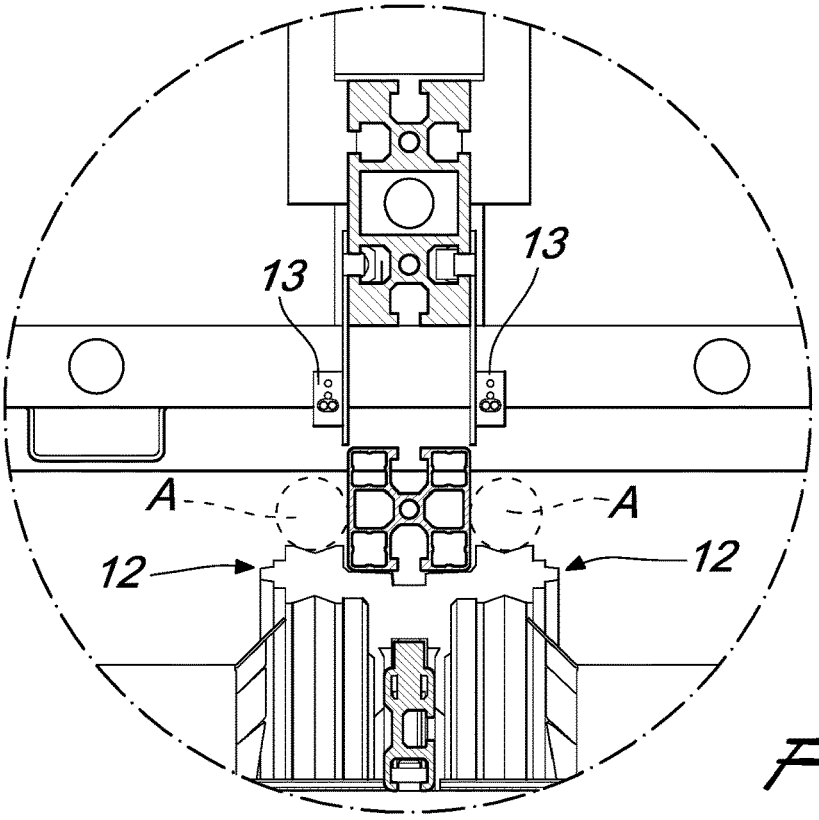
FIG. 11 is a highly enlarged-scale view of a detail of FIG. 9.

The apparatus 1 comprises in series at least one station 2 for loading the horticultural products A, at least one preliminary checking station 3, at least one alignment station 4, at least one viewing station 5 and at least one distribution station 6 (in FIG. 1, they are arranged from right to left, whereas in FIGS. 2 and 3 the viewing station 5 and the distribution station 6 are arranged from left to right).

In the loading station 2 the blueberries can be loaded in various manners and can be for example transferred or tipped onto it (manually or by means of adapted devices) from crates filled loosely with these fruits (which typically arrive directly from the picking fields).

At the loading station 2 the blueberries are then affected by adequate handling systems, which transfer them downstream: for example, at least in the first processing steps, the conveyance of the blueberries can be entrusted to one or more conveyor belts.

After the loading station 2, therefore, in the preliminary checking station 3 the blueberries are usually viewed by assigned workers, who remove the ones that evidently do not meet the desired quality criteria (for example because they are evidently defective or rotten) and/or any debris (leaves, twigs, etc.), which sometimes are conveyed together with the crates from the fields.

Furthermore, filters, traps (ducts of predefined width) or similar solutions are normally provided in the checking station 3 and automatically retain the products A that one does not wish to process, again because they are outside of the set criteria.

The alignment station 4 instead has the task of reorganizing the flow of blueberries (for example according to the methods that will be described in the pages that follow in relation to the preferred embodiment, which is not exclusive) so as to then make them subsequently advance in a queue on at least one row, as is necessary for the correct operation of the downstream sections.

Information related to at least one parameter of interest of each horticultural product A is then acquired in the viewing station 5. This parameter can be for example (not exclusively) of the type of color, size, shape, sugar content, defectiveness, and the like.

Subsequently, and indeed as a function of the information acquired from the viewing station 5, the distribution station 6 sorts the products A into subgroups which are uniform (i.e., each of which has the same or similar values of one or more parameters of interest).

Downstream of the distribution station 6, any horticultural products A that are not sorted by said station are picked up by a recirculation apparatus, which sends them back at least to the viewing station 5.

These products A are in fact typically the ones for which a malfunction of the viewing station 5 has made it impossible to detect the information of interest. When this occurs, the distribution station 6 is evidently unable to assign the product A to the correct subgroup: the recirculation apparatus therefore allows the viewing station 5 to perform the check again and, trusting that the error will not reoccur (since in any case it depends on at least partially random factors), in practice recover the horticultural product A, sending it in a correct manner, with a second cycle, to the final steps.

Figure 1A:
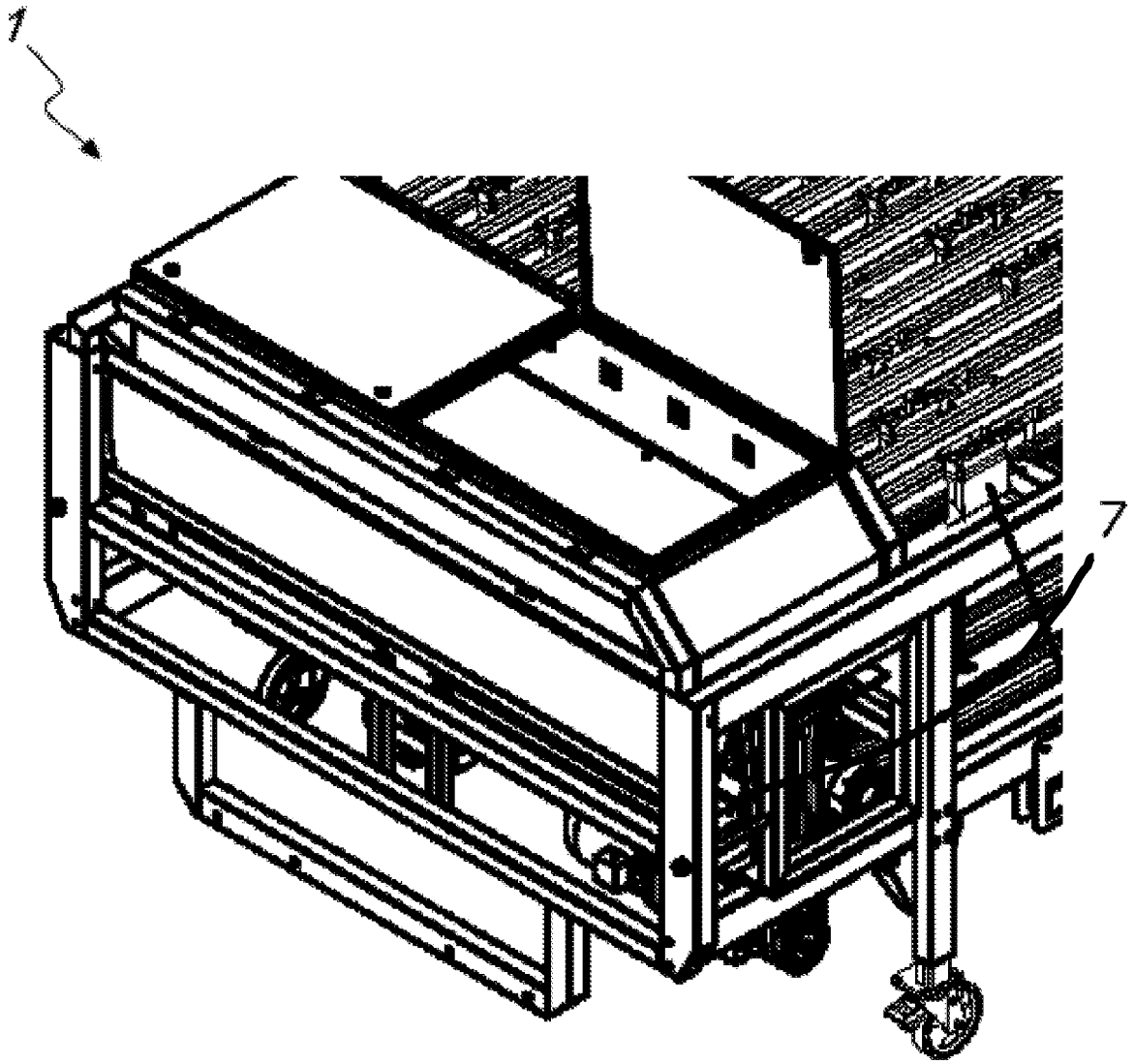
FIG. 1*a* is an exploded view of one end of the apparatus of FIG. 1.

According to the disclosure, the recirculation apparatus comprises at least one conveyor belt 7, as seen in FIG. 1*a*, which is functionally arranged downstream of the distribution station 6 and leads, even indirectly, to the viewing station 5.

The expression "functional" arrangement indeed means that it performs its role on the blueberries after the distribution station 6 and that by virtue of its position it can receive the horticultural products A that have not been distributed previously by the apparatus 1, to then send them to the viewing station 5.

The accompanying figures show a solution in which the conveyor belt 7 is composed of a single straight portion which (downstream) is adjacent to the distribution station 6; in this solution, downstream of the conveyor belt 7 there is an additional auxiliary belt (not shown for the sake of simplicity), which runs parallel to the orientation along which the blueberries advance in the preceding steps, but in the opposite direction, indeed so as to return to the viewing station 5 the blueberries that have not been treated adequately.

The provision of recirculation apparatuses in which there is a single conveyor belt 7 or there is a conveyor belt 7 and two or more auxiliary belts, in any case able, as a whole, to receive the blueberries from the distribution station 6 and return them to the viewing station 5, is not excluded.

Furthermore, the apparatus 1 comprises at least one sensor 8 for detecting the transit of horticultural products A above and at a predefined height with respect to the conveyor belt 7.

The height is appropriately chosen so as to correspond to a predefined limit value of products A, which are accumulated and in transit on the conveyor belt 7.

For example, therefore, the arrangement of the detection sensor 8 can be such as to give it the possibility to detect blueberries in transit at a height that is equal to a multiple of the average space occupation of said blueberries.

In optimum (or in any case acceptable) operating conditions, the blueberries are rested and conveyed only occasionally on the conveyor belt 7 and thus travel individually downstream and do not accumulate against each other, and therefore are not identified by the detection sensor 8.

When instead a malfunction for which a significant number of blueberries is unloaded onto the conveyor belt 7 occurs upstream, said blueberries tend to accumulate against each other and therefore their presence is detected by the detection sensor 8, allowing the prompt activation of adequate countermeasures.

Likewise, the detection sensor 8 allows to activate prompt countermeasures also when the conveyor belt 7 itself is not operating correctly: if the latter is for some reason in a stopped condition (or is moving slower than intended), the blueberries again accumulate against each other, being promptly detected by the detection sensor 8.

Indeed to allow the activation of adequate countermeasures, the detection sensor 8 is associated with an electronic unit.

The electronic unit is assigned to the processing of the information acquired by the detection sensor 8 and to the generation of an alarm signal if indeed horticultural products A in transit at the predefined height are detected.

The electronic unit can be of any kind and can be for example a controller or an electronic computer; typically, it is the same electronic device that controls the operation of the entire apparatus 1, but the provision of a device designed exclusively for the function cited above is not excluded.

The alarm signal also may be any: an acoustic message that can be heard clearly in the building, a luminous message (the flashing of a lamp), an information technology message transmitted toward the personal computer (or the smartphone) of one or more operators, etc. (and also a combination of two or more of the above).

In particular, although other possible constructive solutions are not excluded which are in any case within the protective scope claimed herein, the detection sensor 8 is chosen between a proximity sensor and an optical sensor.

For example, therefore, the detection sensor 8 can be of the type of a proximity sensor of the inductive, capacitive, magnetic, ultrasonic, optical type, etc., as a function of the specific requirements.

As an alternative, the detection sensor 8 can implement one of the various known technologies for optical sensors, again as a function of the specific requirements.

Even more particularly, in the preferred constructive solution the detection sensor 8 is a photoelectric sensor, also known as photocell.

As can be deduced for example from FIGS. 4 to 8, the photoelectric sensor comprises an emitter 9 of a beam of light 10 which is normally directed toward a respective receiver 11. The choice of the position of the emitter 9 and of the receiver 11 is made so as to ensure the crossing of an area that lies above at least one segment of the conveyor belt 7 on the part of the beam of light 10. Of course, said area is at a distance from the corresponding segment that is equal to the predefined height.

It is specified that it is possible to mount in the respective seats the emitter 9 and the receiver 11 with the possibility of vertical sliding, so as to vary at will the height at which the beam of light 10 is emitted, obtaining quick and practical calibrations of the apparatus 1 (or also new settings if the average dimensions of the products A or their very type are changed). This makes the apparatus 1 according to the disclosure extremely versatile.

Even more particularly, and with further reference to the cited FIGS. 4 to 8, in the preferred solution the emitter 9 and the receiver 11 are aligned along the direction of advancement of the horticultural products A that is defined by the conveyor belt 7.

In this manner, as indeed is evident from the figures, the beam 10 lies above (and is substantially parallel to) the entire conveyor belt 7 (or at least all of its segment comprised between the emitter 9 and the receiver 11).

This solution is of extreme practical interest, since it allows to detect unwanted accumulations of blueberries in any point of the conveyor belt 7 with a single photocell.

In the solution shown in the accompanying figures, the emitter 9 is arranged upstream with respect to the receiver 11, but opposite solutions, for example therefore with the receiver 11 mounted at the inlet of the conveyor belt 7 and the emitter 9 downstream, are not excluded.

It should be noted that the viewing station 5 and the distribution station 6 are crossed by at least one line 12 for the transit of the horticultural products A, which leads to the conveyor belt 7.

Along the transit line 12 the blueberries can continue to rest on adapted handling units, which indeed advance along a trajectory that is affected by the viewing station 5 and by the distribution station 6 and then makes them unload the untreated horticultural products A (preferably) directly onto the conveyor belt 7.

While noting that the apparatus 1 can be constituted by a single transit line 12, along which the blueberries indeed advance one by one, in the preferred embodiment, illustrated by way of nonlimiting example in the accompanying figures, the viewing station 5 and the distribution station 6 are crossed by a plurality of transit lines 12 (which are mutually parallel) for the horticultural products A, which are queued along corresponding lines by the alignment station 4.

Obviously, the choice to resort to a plurality of lines 12 (along each of which the blueberries advance one by one) allows to increase significantly the productivity of the apparatus 1 according to the disclosure.

In any case, whatever the number of lines 12, in order to increase the capacity of the apparatus 1 to detect promptly any malfunctions along each line 12, downstream of the distribution station 6 there is a respective sensor 13 for checking for any presence of horticultural products A.

Therefore, if the apparatus 1 has a single portion 12, a single checking sensor 13 is sufficient; if the (parallel) portions 12 are several, the apparatus 1 has a corresponding number of checking sensors 13.

The checking sensor 13 is associated with the already mentioned electronic unit (or also with a dedicated device that is independent from said unit): in this particular constructive solution, the electronic unit is therefore provided with at least one module for counting the number of detected horticultural products A.

The presence of the checking sensor 13 therefore offers additional monitoring possibilities of the apparatus 1.

More particularly, the electronic unit is provided with a module for the constant (continuous or otherwise periodic) comparison of the number of horticultural products A detected by the checking sensor 13 over predefined time periods, with a preset threshold.

Thus, when the counted number exceeds the threshold, indicating a negative drift in the operation of the viewing station 5 (an unacceptable rise in the number of blueberries for which a correct reading has not been possible), the electronic unit can promptly send an additional alarm signal, optionally stopping the apparatus 1 and/or otherwise allowing rapid intervention of the operators.

As already noted for the detection sensor 8, the checking sensor 13 also is chosen between a proximity sensor and an optical sensor and preferably is indeed a photoelectric sensor (a photocell), even of the type of said detection sensor 8.

Both the detection sensor 8 and the checking sensor 13 are in fact photocells (of the same type or of different types), although one or both may be of another kind, chosen adequately as a function of the specific requirements.

For the checking sensors 13 as well, it should be noted that the number of blueberries counted by them can be also composed of products A for which the malfunction occurred at the distribution station 6 or anyway in other upstream points.

In one embodiment of considerable practical interest, the alignment station 4 comprises at least one sequence of longitudinally aligned pairs of movable belts 14, which are arranged in a V-shape and have a progressively decreasing center distance, for the progressive queuing of the horticultural products A.

When the transit lines 12 are more than one (as in the accompanying figures), each line 12 is preceded by a respective sequence (three, for example) of pairs of movable belts 14, so as to obtain a matching number of rows of blueberries queued one by one.

In the alignment station 4, the blueberries are then forced to pass in series through the interspaces (which are progressively narrower) comprised between the pairs of movable belts 14: the mechanical action of said belts, which are indeed movable, makes the blueberries align automatically and progressively even when they enter the interspaces in a side-by-side configuration without alignment.

In this sense, indeed the choice to resort to a sequence of pairs of movable belts 14, with a progressively decreasing center distance, allows a gradual alignment, in order to ensure the desired result in a manner that respects the integrity of the horticultural products A (and therefore without damage thereto and avoiding any jamming).

In the preferred embodiment, the viewing station 5 comprises at least one video camera (and preferably one for each line 12), which is associated with the electronic unit, which in turn is provided (or also associated with an additional device that is provided) with a software for the analysis of the images acquired by said video camera, in order to determine the information related to the already cited parameters of interest.

Advantageously, the distribution station 6 comprises a plurality of pressurized fluid dispensers which are arranged in series along each transit line 12.

The dispensers can be activated selectively on command during the transit of each product A, preferably (but not exclusively) on the part of said electronic unit, as a function of the information acquired from the viewing station 5.

Each dispenser is capable of sending a jet of the fluid under pressure toward the product A in order to obtain its consequent fall, from the respective handling unit, toward a corresponding collection container 15.

It should be noted therefore that the sorting into uniform subgroups occurs indeed by virtue of the cooperation between the viewing station 5 and the distribution station 6, which is preferably controlled by the electronic unit.

In fact, for each blueberry in transit the electronic unit activates the dispenser arranged in functional connection to the specific collection container 15, which is indeed designed to accommodate all and only the blueberries for which the parameters of interest assume certain values.

The jet of compressed air causes the blueberries to fall from the respective handling unit, on which they rest and are conveyed along the line 12, thus directing them toward the underlying area, where they are received by transfer belts which indeed lead to respective containers 15 (or directly by the containers 15, if one chooses to arrange them below the line or lines 12).

In order to ensure optimum conveyance of the blueberries during their fall, on the opposite side with respect to the corresponding transit line 12 a respective baffle 16 is arranged opposite each dispenser and is designed to divert the horticultural products A that are struck by the jet.

The operation of the apparatus according to the disclosure is evident from what has been outlined so far: it has in fact already been shown that the blueberries are subjected to the action of a plurality of devices and stations 2, 3, 4, 5, 6, which cooperate to perform a plurality of automated activities on the products A, in order to deliver them to collection containers 15 in uniform subgroups (which lack impurities and rotten or otherwise defective fruits).

The presence of the detection sensor 8, arranged with its beam of light 10 at an adequate height, with respect to the conveyor belt 7, allows to affect unwanted accumulations of blueberries, which indicate a malfunction of the viewing station 5, of the distribution station 6 and/or of the conveyor belt 7 (or in any case of upstream devices).

Therefore, it is possible to identify promptly a negative drift in the operation of the video cameras assigned to viewing the blueberries (and more generally of the apparatus 1), thus being able to intervene rapidly, avoiding the danger that the apparatus 1 operates for a long period of time in conditions of limited productivity.

Furthermore, if the conveyor belt 7, normally assigned to recirculation, suddenly stops due to a malfunction, it is also possible to avoid accumulations and jamming of blueberries, or otherwise stop them as they begin, thus avoiding significant impacts and deteriorations on said blueberries.

At the same time, the number of horticultural products A subjected to reprocessing is reduced to a minimum tolerable value, since indeed the detection sensor 8 ensures the possibility to activate adequate countermeasures as soon as the number of accumulated blueberries rises in an unwelcome manner.

Therefore, the number of damaged or defective blueberries (due to the handling and treatments performed by the apparatus 1) is kept at negligible (or even nil) values.

From what has been observed above, one deduces therefore that usefully the apparatus 1 ensures high productivity and high quality levels, which are evidently appreciated in the treatment of any horticultural product A and even more in relation to high-value fruits, as indeed are blueberries.

The useful functionalities cited above, and the benefits that can be achieved advantageously by means of the detection sensor 8, are further increased if the checking sensors 13 are implemented, ensuring further monitoring of the operating conditions of the viewing station 5 and in general of the upstream devices.

The disclosure thus conceived is susceptible of numerous modifications and variations; all the details may further be replaced with other technically equivalent elements.

In the exemplary embodiments shown, individual characteristics, given in relation to specific examples, may actually be interchanged with other different characteristics that exist in other exemplary embodiments.

In practice, the materials used, as well as the dimensions, may be any according to the requirements and the state of the art.

The disclosures in Italian Patent Application No. 102016000018797 (UB2016A001024) from which this application claims priority are incorporated herein by reference.

The invention claimed is:

1. An apparatus for treating horticultural products comprising in series at least one station for loading the horticultural products, at least one preliminary checking station, at least one alignment station for their subsequent advancement aligned on at least one row, at least one viewing station for acquiring information related to at least one parameter of interest of each horticultural product, at least one distribution station for sorting the products into uniform subgroups, as a function of the information acquired by said viewing station, and at least one recirculation apparatus for returning, at least to said viewing station, any horticultural products that have not been sorted by said distribution station, wherein said recirculation apparatus comprises at least one conveyor belt functionally arranged downstream of said distribution station and leads to said viewing station, said apparatus comprising at least one sensor for detecting the transit of horticultural products above and at a predefined height, with respect to said conveyor belt, said height being chosen so as to correspond to a predefined limit value of products that have accumulated and are passing on said conveyor belt.

2. The apparatus according to claim 1, wherein said detection sensor is associated with an electronic unit for processing the information acquired by said detection sensor and for generating an alarm signal if horticultural products in transit at said predefined height are detected.

3. The apparatus according to claim 1, wherein said at least one detection sensor is chosen between a proximity sensor and an optical sensor.

4. The apparatus according to claim 1, wherein said at least one detection sensor is a photoelectric sensor, which comprises an emitter of a beam of light that is normally directed toward a respective receiver, said beam of light passing through an area that lies above at least one segment of said conveyor belt.

5. The apparatus according to claim 4, wherein said emitter and said receiver are aligned along the advancement direction of the horticultural products that is defined by said conveyor belt.

6. The apparatus according to claim 1, wherein said viewing station and said distribution station are crossed by at least one line for the transit of the horticultural products, which leads to said conveyor belt, along said at least one line, downstream of said distribution station, there being a respective checking sensor for checking for any presence of horticultural products, which is associated with said electronic unit, which is provided with at least one module for counting the number of horticultural products detected.

7. The apparatus according to claim 6, wherein said checking sensor is chosen between a proximity sensor and an optical sensor.

8. The apparatus according to claim 6, wherein said at least one distribution station comprises a plurality of dispensers of pressurized fluid, which are arranged in series along said at least one transit line and can be activated selectively on command, during the transit of each product, by said electronic unit, as a function of the information acquired by said viewing station, in order to send a jet of the pressurized fluid toward the product and for its consequent fall, from a respective handling unit, toward a corresponding collection container, each one of said dispensers, on an opposite side with respect to said transit line, being opposed by a respective baffle for diverting the horticultural products struck by said jet and for an optimum conveyance of said horticultural products.

9. The apparatus according to claim 1, wherein said at least one alignment station comprises at least one sequence of pairs, aligned longitudinally, of movable belts arranged in a V-shaped configuration with a progressively decreasing center distance for the progressive queuing of the horticultural products.

10. The apparatus according to claim 1, wherein said at least one viewing station comprises at least one video camera, associated with said electronic unit, said electronic unit being provided with software for analyzing the images acquired by said video camera, in order to determine the information related to said at least one parameter of interest.

* * * * *